US005412456A

United States Patent [19]

Tanuma et al.

[11] Patent Number: 5,412,456

[45] Date of Patent: May 2, 1995

[54] DEVELOPING APPARATUS

[75] Inventors: Chiaki Tanuma, Tokyo; Mitsunaga Saito, Ichikawa; Yukihiro Osugi, Shizuoka, all of Japan

[73] Assignees: Kabushiki Kaisha Toshiba, Kanagawa; Tokyo Electric Co., Ltd., Tokyo, both of Japan

[21] Appl. No.: 117,595

[22] Filed: Sep. 8, 1993

[30] Foreign Application Priority Data

Sep. 9, 1992 [JP] Japan ..... 4-240662

[51] Int. Cl.[6] ..... G03G 15/06

[52] U.S. Cl. ..... 355/245; 355/259; 118/653; 118/656

[58] Field of Search ..... 355/259, 245, 251, 253; 118/653, 644, 656, 661

[56] References Cited

U.S. PATENT DOCUMENTS

| | | | |
|---|---|---|---|
| 3,152,012 | 10/1964 | Schaffert . | |
| 3,731,148 | 5/1973 | Fournis . | |
| 4,266,868 | 5/1981 | Bresina | 355/253 |
| 4,872,036 | 10/1989 | Homma | 355/253 |
| 4,947,211 | 8/1990 | Ono et al. | 355/259 X |
| 4,990,959 | 2/1991 | Yamamuro et al. | 355/245 |
| 5,128,722 | 7/1992 | Natsuhara et al. | 355/259 |
| 5,170,213 | 12/1992 | Yamaguchi et al. | 355/259 X |
| 5,185,496 | 2/1993 | Nishimura et al. | 355/259 X |
| 5,214,239 | 5/1993 | Koga et al. | 355/259 X |
| 5,223,898 | 6/1993 | Fujii et al. | 355/259 |

FOREIGN PATENT DOCUMENTS

| | | | |
|---|---|---|---|
| 47-13088 | 7/1972 | Japan . | |
| 47-13089 | 7/1972 | Japan . | |
| 0089750 | 7/1981 | Japan | 355/259 |
| 0102870 | 8/1981 | Japan | 355/259 |
| 0116372 | 7/1982 | Japan | 355/259 |
| 59-121347 | 7/1984 | Japan . | |
| 59-151173 | 8/1984 | Japan . | |
| 0024283 | 2/1987 | Japan | 355/259 |
| 0200376 | 9/1987 | Japan | 355/259 |
| 0098676 | 4/1988 | Japan | 355/259 |
| 5-27567 | 2/1993 | Japan . | |

*Primary Examiner*—Matthew S. Smith

*Attorney, Agent, or Firm*—Finnegan, Henderson, Farabow, Garrett & Dunner

[57] ABSTRACT

A developing apparatus is disclosed which is disposed opposite to an electrostatic latent image holding member and adapted for developing an electrostatic latent image formed on the electrostatic latent image holding member to a visible image with a single component toner, the apparatus comprising a first toner carrier having a peripheral surface and being adapted for holding the single component toner on the peripheral surface, a first regulating member which is in contact with the first toner carrier, a second toner carrier having a peripheral surface and being adapted for holding the single component toner and for relatively approaching to or coming in contact with the first toner carrier so as to transfer the single component toner to the first toner carrier, and a second regulating member which is in contact with the second toner carrier, wherein the first toner carrier or the second toner carrier is adapted to relatively and selectively approach to or come in contact with the electrostatic latent image holding member and transfer to the electrostatic latent image holding member either a single component toner held on the peripheral surface of the first toner carrier or a single component toner which resides on the peripheral surface of the second toner carrier after the single component toner has been transferred from the second toner carrier to the first toner carrier so as to develop the electrostatic latent image to the visible image with the single component toner.

11 Claims, 6 Drawing Sheets

DEVELOPING APPARATUS

BACKGROUND OF THE INVENTION

1. Field of the Invention

The present invention relates to a developing apparatus used in an electrophotographic device and an electrostatic recording device for developing an electrostatic latent image to a visible image, more particularly, to a developing apparatus for producing a high quality image with a single component toner.

2. Description of the Related Art

As a developing method of an electrostatic latent image with a single component type developing agent (toner), impression development method is known. In this developing method, an electrostatic latent image holding member and a toner carrier are contacted at a relative surface speed of substantially zero (as disclosed in U.S. Pat. Nos. 3,152,012 and 3,731,148 and Japanese Patent Application Laid-Open Nos. SHO 47-13088 and SHO 47-13089). According to this developing method, since no magnetic materials are required, the apparatus can be simply and compactly constructed. In addition, color toners can be easily used.

An electrophotographic recording apparatus according to this developing method comprises an electrostatic latent image holding member (for example, a photosensitive drum), a charging means, an electrostatic latent image forming means, a developing apparatus, a transferring means, and a fixing means. The electrostatic latent image holding member forms and holds an electrostatic latent image. The charging means charges the peripheral surface of the electrostatic latent image holding member. The electrostatic latent image forming means exposes the peripheral surface of the electrostatic latent image holding member equally charged by the charging means corresponding to an image information signal and forms an electrostatic latent image. The developing apparatus develops the electrostatic latent image on the peripheral surface of the electrostatic latent image holding member by the electrostatic latent image forming means to a visible image with a developing agent (toner). The transferring means transfers the visible toner image formed on the peripheral surface of the electrostatic latent image holding member by the developing apparatus to a recording medium. The fixing means fixes the toner image on the recording medium with a pressure and heat.

However, in the impression development method, the toner carrier which holds a toner on its peripheral surface is pressured or contacted with the electrostatic latent image holding member so as to develop an image. Thus, the toner carrier must be an elastic and electroconductive roller. In particular, when the electrostatic latent image holding member is a rigid substance, the toner carrier must be made of an elastic material so as to prevent the electrostatic latent image holding member from being damaged. In addition, to provide development electrode effect and bias effect, an electroconductive layer is preferably disposed on the peripheral surface of the toner carrier or in the vicinity thereof so as to apply a bias voltage thereto. The toner is frictionally charged by the toner carrier and a regulating member (regulating blade) which forms a thin toner layer on the peripheral surface of the toner carrier. Thus, the regulating member must be contacted with the peripheral surface of the toner carrier so that a predetermined nip width is provided. In this case, the regulating member is preferably made of a frictionally chargeable material so that the regulating member properly charges the toner. Particularly, in a reversal development system (for use in laser printers, digital PPCs, and so forth) which negatively charges the surface of a photosensitive material (electrostatic latent image holding member) and then develops an image with a toner negatively charged, a toner carrier and a regulating member made of silicone rubber which is positively chargeable are widely used.

FIG. 1 is a sectional view showing the construction of principal portions of a conventional developing apparatus. In the figure, reference numeral 2 is a toner carrier. The toner carrier 2 is constructed of a semiconductive roller on which an elastic layer is formed. Reference numeral 3 is a regulating member. The regulating member 3 forms a negatively charged thin toner layer on the peripheral surface of the toner carrier 2. In the figure, reference numeral 4 is a toner supply member which supplies a toner 5 to the peripheral surface of the toner carrier 2. Reference numeral 6 is a toner hopper which stocks the toner 5 and so forth. Reference numeral 7 is a toner agitating member. Reference numeral 8 is a waste toner collecting member. Reference numeral 9 is a regulating member holding mechanism which elastically pressurizes and holds the regulating member 3. Reference numeral 1 is an electrostatic latent image holding member opposed to the developing apparatus.

In an image forming process of the developing apparatus, the peripheral surface of the electrostatic latent image holding member 1 is equally charged by a charging means such as a corona charger (not shown). An electrostatic latent image corresponding to image information is formed by an electrostatic latent image forming means such as laser light (not shown). Thereafter, a thin toner layer formed and held on the peripheral surface of the toner carrier 2 is contacted with the peripheral surface of the electrostatic latent image holding member 1. Thus, a visible image is formed by the toner 5. Next, the visible toner image formed on the peripheral surface of the electrostatic latent image holding member 1 is transferred to a recording medium by a transferring means such as a Corotoron type charger (not shown). The visible toner image is fixed on the recording medium by a fixing means (not shown). Thus, a predetermined image is formed.

On the other hand, as the DTP (Desk Top Publishing) market is growing, images including graphics as well as characters are required. Thus, reproducibility of gray scale images is becoming important. In the above-described developing method using a single component toner, gray scale images cannot be properly reproduced. As a factor which deteriorates the reproducibility, there is a sleeve ghost. The sleeve ghost results from hysteresis phenomenon caused by a developing roller as a toner carrier. For example, after a solid image has been printed, when a gray scale zone is printed, there will be a difference of density between the solid image and gray scale image. Thus, an uneven density takes place at intervals of the peripheral length of the developing roller. The uneven density is remarkable at a gray scale portion. This uneven density especially deteriorates the reproducibility of an image. Thus, to form high quality images with high reproducibility, the problem of the sleeve ghost must be solved as a primary condition. However, so far, the countermeasures against the sleeve ghost have not been satisfactorily taken.

In addition, when an image contains graphics, they must be precisely formed. In other words, when characters are printed, a satisfactory image density is required. Thus, the diameter of toner particles must be relatively large. On the other hand, when an image containing graphics is printed, fine lines must be precisely reproduced. Thus, when a toner whose particle diameter is large is used, lines may be overlapped. Consequently, when a graphic image is printed, a toner whose particle diameter is relatively small must be used. To satisfy these requirements, high resolution technology using a toner whose particle diameter is small is being developed. In other words, the resolution of the image forming apparatus is being changed from 300 dots/inch to 600 dots/inch. Thus, toner particle diameters are being changed from 10 μm to 7 to 8 μm.

However, as the resolution of printing images improves, several problems arise. As a typical problem, the production of a toner whose particle diameter is small is not easy. Conventionally, a toner is produced by so-called grinding and screening method. In this method, a resin block which was mixed and kneaded as a toner material is mechanically ground and screened into toner particles with required particle diameters. However, in the conventional mechanical grinding method, toner particles with diameters of 7 μm and 8 μm are not effectively collected. In other words, since toner particles whose diameters are 10 μm or larger are removed from those ground by the conventional grinding device, the amount of toner particles with smaller diameters becomes very small. Thus, the production cost of the toner remarkably rises.

SUMMARY OF THE INVENTION

The present invention is made from the above-described stand points. An object of the present invention is to provide a developing apparatus for developing a high quality image which is free of uneven density, fogging at non-image portion, and a sleeve ghost as hysteresis phenomenon of a developing roller.

Another object of the present invention is to provide a developing apparatus for effectively forming both a sharp and high-density character image and a high-resolution graphic image using a conventional toner which can be obtained by a conventional method.

An apparatus of the present invention is a developing apparatus disposed opposite to an electrostatic latent image holding member and adapted for developing an electrostatic latent image formed on the electrostatic latent image holding member to a visible image with a single component toner, the apparatus comprising a first toner carrier having a peripheral surface and being adapted for holding the single component toner on the peripheral surface, a first regulating member which is in contact with the first toner carrier, a second toner carrier having a peripheral surface and being adapted for holding the single component toner and for relatively approaching to or coming in contact with the first toner carrier so as to transfer the single component toner to the first toner carrier, and a second regulating member which is in contact with the second toner carrier, wherein the first toner carrier or the second toner carrier is adapted to relatively and selectively approach to or come in contact with the electrostatic latent image holding member and transfer to the electrostatic latent image holding member either a single component toner held on the peripheral surface of the first toner carrier or a single component toner which resides on the peripheral surface of the second toner carrier after the single component toner has been transferred from the second toner carrier to the first toner carrier so as to develop the electrostatic latent image to the visible image with the single component toner.

In other words, according to the first aspect of the present invention, a toner carrier means is constructed of two toner carriers. The second toner carrier charges a toner. The first toner carrier controls the thickness of a thin toner layer.

A second aspect of the present invention is a developing apparatus having a plurality of toner carriers. The plurality of toner carriers are switched so as to develop an electrostatic latent image on the electrostatic latent image holding member to a visible image. Thus, these toner carriers are disposed so that thin toner layers on the toner carriers can be contacted with or approached to the electrostatic latent image holding member and thereby the thin toner layers are adhered to the electrostatic latent image. The single component toner is supplied to the toner carriers and charged by a conventional toner supply member and the like. The toner supply member is disposed so that it can be contacted with or approached to one of the plurality of toner carriers which constructs the developing apparatus. In addition, a means for applying an electric field between the toner carriers and between the toner carrier and toner supply member is disposed.

According to the first aspect of the present invention, a toner carrier means is constructed of at least two toner carriers. One toner carrier charges a toner. The other toner carrier controls the thickness of the thin toner layer. In other words, to form an image with high reproducibility and quality, the problem of a sleeve ghost must be solved. From intensive study made by the inventors of the present invention, it was revealed that when the toner carrier is constructed of at least two functional members, a single component toner which develops an electrostatic latent image to a visible image is satisfactorily charged and the amount of toner (thickness of the thin toner layer) can be very easily controlled. In the conventional system, the particle size distribution of a single component toner is broad and small diameter toner particles remain. Thus, after an image has been developed, a large amount of toner particles resides on the peripheral surface of a toner carrier. As a result, an image deterioration results. However, according to the present invention, when a single component toner charged on the peripheral surface of a second toner carrier is transferred to a first toner carrier, the particle size distribution is sharply controlled. Thus, after the image has been developed, the amount of toner particles which resides on the first toner carrier which is approached or is in contact with the electrostatic latent image holding member is remarkably reduced. Consequently, it seems that a stable and high quality image free of uneven image density, fogging, and deterioration can be formed.

Next, experimental results about the particle size distribution of the toner on the two toner carriers will be described.

FIG. 2 shows a measurement result of the particle size distribution of a toner on the second toner carrier. FIG. 3 shows a measurement result of the particle size distribution of a toner on the first toner carrier. In FIG. 2, line (a) represents the particle size distribution of the toner on the second toner carrier before a single component toner is transferred to the first toner carrier. Line (b) represents the particle size distribution of the toner transferred from the second toner carrier to the first toner carrier. Line (c) represents the particle size distribution of the toner which resides on the second toner carrier after the single component toner is transferred to the first toner carrier. In FIG. 3, line (a) represents the particle size distribution of the toner on the first toner carrier before the single component toner is adhered to an electrostatic latent image on the electrostatic latent image holding member. Line (b) represents the particle size distribution of the toner adhered to the electrostatic latent image holding member after the toner has been transferred from the first toner carrier. Line (c) represents the particle size distribution of the toner which resides on the first toner carrier after the single component toner has been adhered to the electrostatic latent image holding member. As is clear from the figures, it is revealed that small diameter particles of the single component toner held on the peripheral surface of the second toner carrier reside on the second toner carrier after the single component toner has been transferred to the first toner carrier. When the single component toner is transferred from the second toner carrier to the first toner carrier, small diameter toner particles have been removed. Thus, the particle size distribution of the toner adhered to the photosensitive drum (electrostatic latent image holding member) almost accords with that of the toner adhered to the first toner carrier. Since the toner carrier means is constructed of two toner carriers, even if a single component toner with a broad particle size distribution is used, an electrostatic latent image can be developed on the photosensitive drum with relatively same diameter toner particles.

In addition, according to the present invention, since the toner carrier means is constructed of at least two functional members, the material and construction of the toner carriers and regulating members can be properly selected so that the toner is properly charged and the thickness thereof is constantly controlled. In other words, according to the present invention, since more preferable (optimum) developing conditions can be selected and designated, a stable and high quality image free of uneven density and fogging can be always and easily formed.

According to the second aspect of the present invention, since the developing apparatus has a plurality of toner carriers, even if a relatively cheap toner with a broad particle size distribution is used, as described with reference to FIGS. 2 and 3, since a first toner carrier which forms a thin toner layer with relatively small diameter toner particles and a second toner carrier which forms a thin toner layer with relatively large diameter toner particles are selectively switched for the electrostatic latent image holding member, an electrostatic latent image on the electrostatic latent image holding member can be developed to a visible image with proper size toner particles corresponding to a desired image. Thus, without necessity of an expensive toner having a narrow distribution of particle size, an image with high resolution can be formed.

These and other objects, features and advantages of the present invention will become more apparent in light of the following detailed description of a best mode embodiment thereof, as illustrated in the accompanying drawings.

DESCRIPTION OF PREFERRED EMBODIMENTS

First Embodiment

Figure 5:
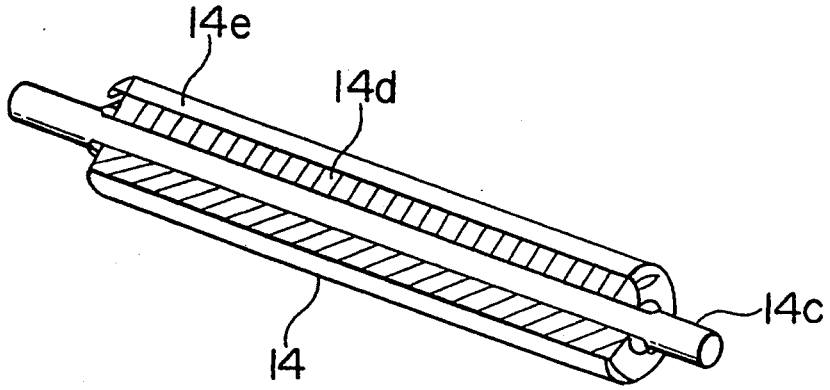
FIG. 5 is a partial perspective view showing the construction of the first toner carrier of the developing apparatus according to the first embodiment of the present invention.
Figure 6:
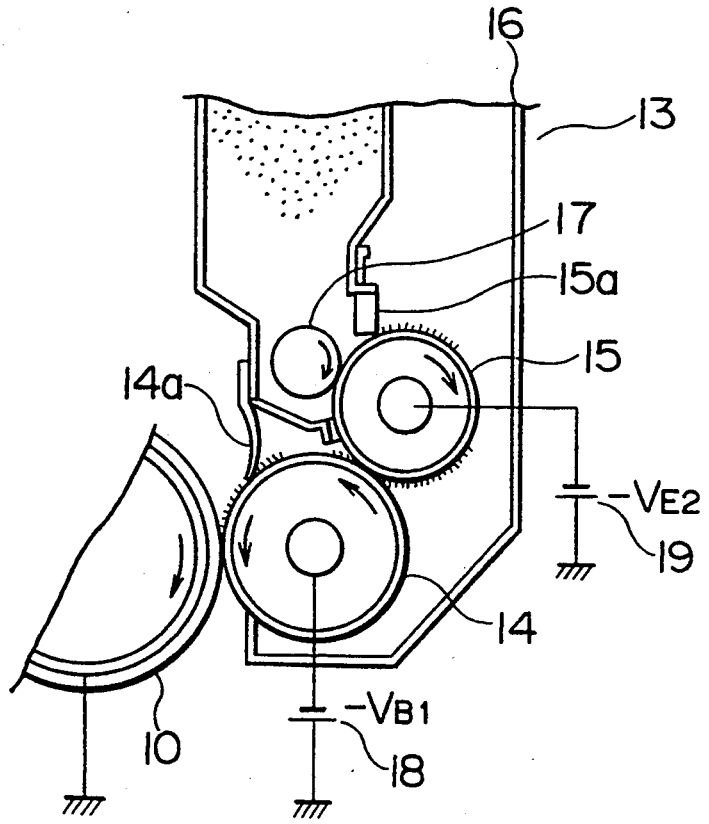
FIG. 6 is a sectional view showing the construction of principal portions of a developing apparatus according to another example of the first embodiment of the present invention.

Next, with reference to FIGS. 4 to 6, a first embodiment of the present invention will be described.

Figure 1:
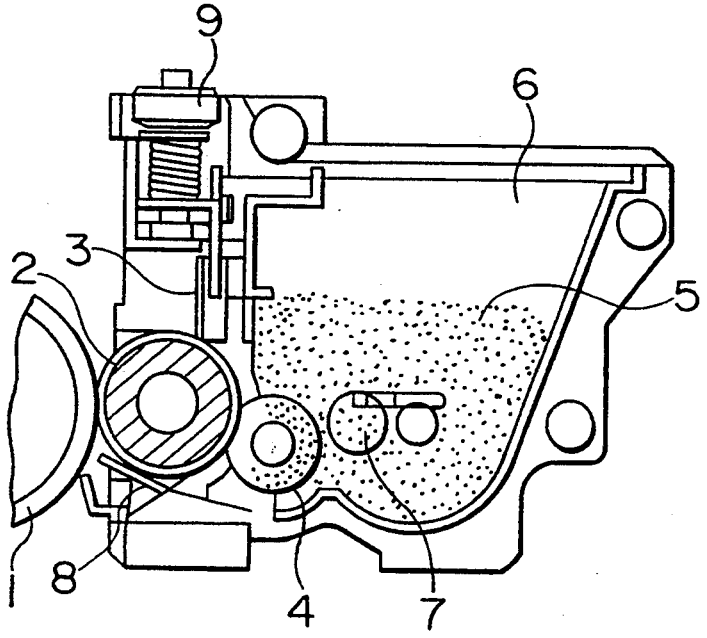
FIG. 1 PRIOR ART
FIG. 1 is a sectional view showing the construction of principal portions of a conventional developing apparatus.
Figure 2:
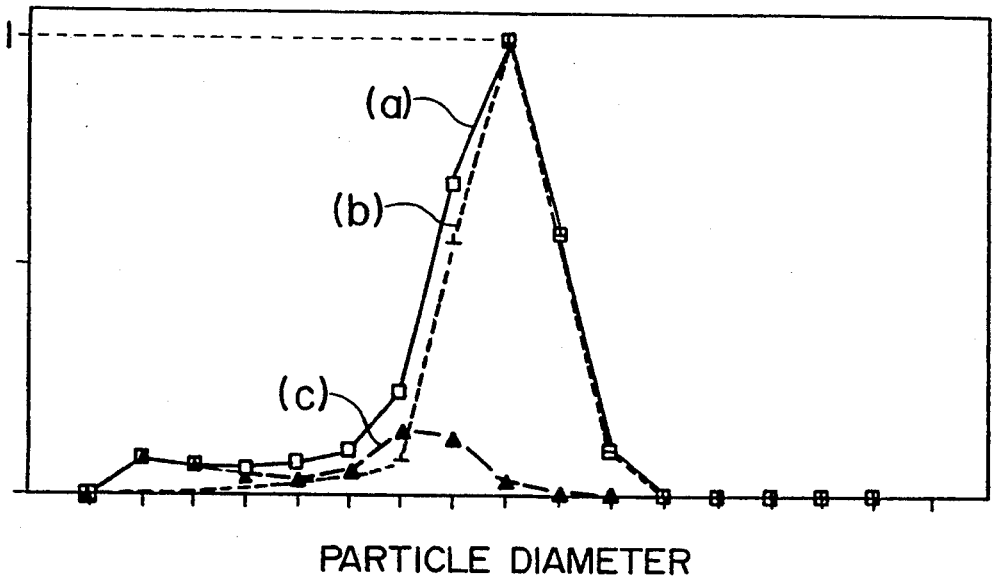
FIG. 2 is a graph for explaining a particle size distribution of a toner on the peripheral surface of a second toner carrier of a developing apparatus according to the present invention.
Figure 3:
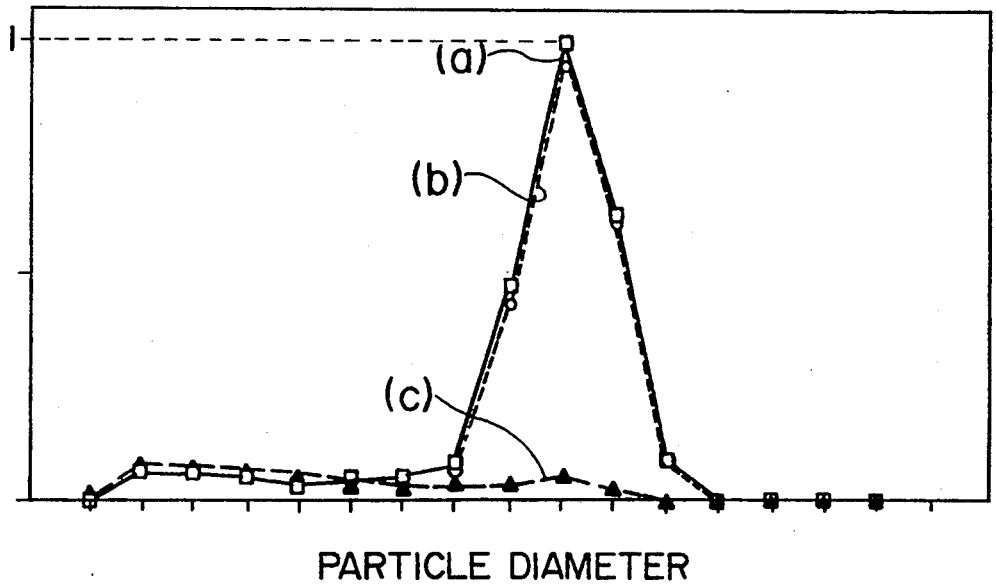
FIG. 3 is a graph for explaining a particle size distribution of a toner on the peripheral surface of a first toner carrier of the developing apparatus according to the present invention.
Figure 4:
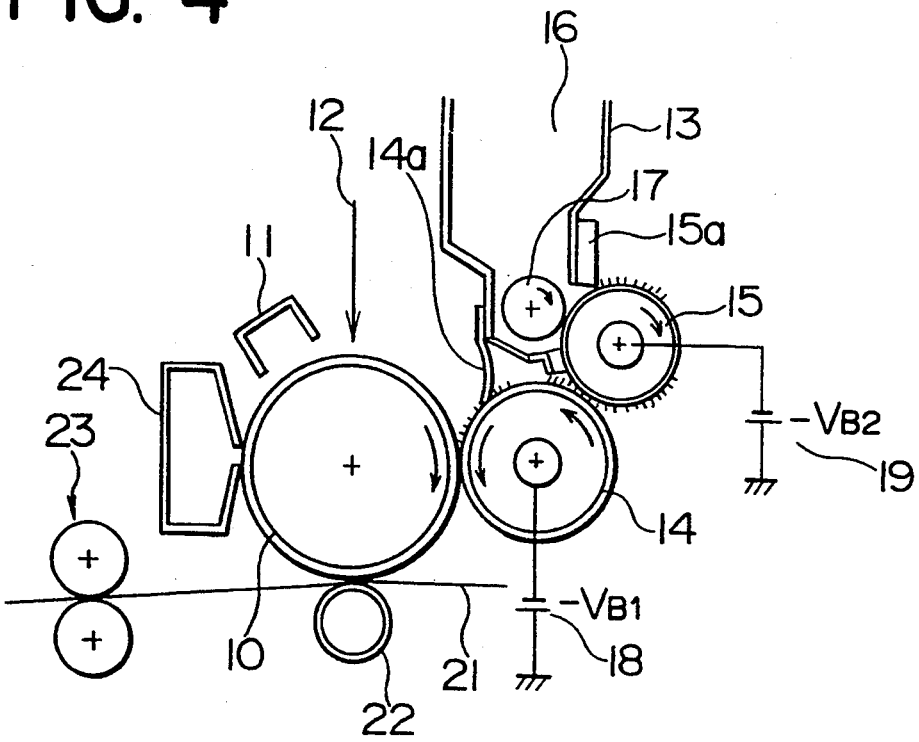
FIG. 4 is a sectional view showing the construction of principal portions of the developing apparatus according to a first embodiment of the present invention.

FIG. 4 is a sectional view showing the construction of principal portions of an image forming apparatus having a developing apparatus according to the present invention. In FIG. 4, reference numeral 10 is an electrostatic latent image holding member (for example, an organic photosensitive drum). Reference numeral 11 is a charger (for example, Scorotron type charger) which charges the peripheral surface of the electrostatic latent image holding member 10. Reference numeral 12 is an exposing means (for example, a laser light source) which forms an electrostatic latent image on the peripheral surface of the electrostatic latent image holding member 10 corresponding to particular image information.

The developing apparatus 13 comprises a first toner carrier 14, a first regulating member (first regulating blade 14*a*), a second toner carrier 15, a second regulating member (second regulating blade 15*a*), a toner hopper 16, a toner supply roller 17, and power supplies 18 and 19. The first toner carrier 14 holds a single component toner on its peripheral surface and relatively approaches or contacts the single component toner to or with an electrostatic latent image on the peripheral surface of the electrostatic latent image holding member 10 so as to develop the electrostatic latent image to a visible image. The first regulating member 14*a* comes in contact with the first toner carrier 14 so as to chiefly control the thickness of a thin toner layer held on the peripheral surface of the first toner carrier 1. The second toner carrier 15 relatively approaches to or comes in contact with the first toner carrier 14 so as to transfer the single component toner to the peripheral surface of the first toner carrier 14. The second regulating member 15*a* comes in contact with the second toner carrier 15 so as to control the charging of the single component toner held on the peripheral surface of the second toner carrier 15. The toner hopper 16 stocks the single component toner. The toner supply roller 17 (as a toner supply member) supplies the toner to the peripheral surface of the second toner carrier 15. The power supplies 18 and 19 apply predetermined voltages to the first and second toner carriers 14 and 15, respectively.

In addition, the developing apparatus 13 further comprises a transferring means (for example, a transfer roller) 22, a fixing means (for example, a heating roller) 23, a waste toner collecting means 24. The transferring means 22 transfers the visible image (toner image) formed on the peripheral surface of the electrostatic latent image holding member 10 to a recording medium 21 conveyed by a conveying means (not shown). The fixing means 23 fixes the toner image being transferred to the recording medium 21. The waste toner collecting means 24 collects the remaining toner adhered to the peripheral surface of the electrostatic latent image holding member 10 after the toner image has been transferred.

As described above, the first toner carrier 14 and the second toner carrier 15 have respective functions. The second toner carrier 15 must equally charge the toner particles and remove toner particles which have not been properly charged and which may adversely affect at the last developing area. In other words, the second toner carrier 15 must transfer only equally charged toner particles to the first toner carrier 14. As described above, it is revealed that when small diameter toner particles are present on the first toner carrier 14, a development memory takes place. When a solid image is developed, small diameter toner particles which have a strong adhering force reside on the peripheral surface of the first toner carrier 14. If a next thin toner layer is formed on the remaining thin toner layer, the small diameter toner particles will prevent the new toner layer from being properly charged. Thus, when the single component toner is transferred from the second toner carrier 15 to the first toner carrier 14, if the small diameter toner particles are not transferred, developing memory can be remarkably reduced.

To achieve the above function, the peripheral surface voltages of the first toner carrier 14 and the second toner carrier 15 are required to be properly applied by the power supplies 18 and 19, respectively. Actually, the peripheral surface voltage of the first toner carrier 14 is preferably higher than that of the second toner carrier 15. If toner particles incorrectly charged are present in the toner, the peripheral surface voltage of the first toner carrier 14 can be lowered than that of the second toner carrier 15 so as to prevent such toner particles from being transferred to the peripheral surface of the first toner carrier 14. The peripheral surface voltages of the first toner carrier 14 and the second toner carrier 15 are designated corresponding to the contacting width thereof, the resistances thereof, and so forth.

In addition to the above-described conditions, to cause the second toner carrier 15 and the second regulating blade 15*a* to stably and effectively friction-charge the toner, the surface materials thereof must be properly selected. In other words, the toner is frictionally charged corresponding to the difference of work functions of the toner and the material with which it is in contact. Thus, the surface materials of the second toner carrier 15 and the second regulating blade 15*a* must have a relatively large work function against a pigment of the toner. On the other hand, the first toner carrier 14 must hold the single component toner transferred from the second toner carrier 15 and adhere the toner to the electrostatic latent image. Alternatively, on peripheral surface of the first toner carrier 14, the single component toner must be mixed with the next thin toner layer so that the electric charge amounts thereof become equal. To improve the developing characteristics of the thin toner layer formed on the peripheral surface of the first toner carrier 14, the first toner carrier 14 must be ohmic-contacted with the single component toner. The surface material of the first toner carrier 14 must have a relatively low work function difference against the toner.

Thus, the materials of the second toner carrier 15 and the second regulating blade 15*a* must be selected from those which can be satisfactorily charged to the toner. An example of the second toner carrier 15 is a metal roller such as an aluminum roller with an outer diameter of approximately 18 mm. The smoothness of the peripheral surface of the second toner carrier 15 which affects the transferring and developing characteristics of the toner is preferably 3 μm Rz or less. When the smoothness of the peripheral surface exceeds 3 μm Rz, an uneven pattern on the peripheral surface tends to appear on a final image. The peripheral surface of the second toner carrier 15 with a smoothness of 3 μm Rz or less can be easily formed by a coarse surface forming treatment according to sand blasting method. The second toner regulating blade 15*a* is produced by mounting a chip on a plate. The chip is formed by coating a layer with a charging property reverse of the toner on an elastic rubber material (such as silicone rubber or urethane rubber) or a resin with a hardness of 30 to 80 in JIS-A standard. The chip is formed on an end portion of a thin plate such as stainless steel, beryllium alloy, or phosphor bronze. The chip is mounted on the second toner regulating blade 15*a* by a bonding method, a nipping method, or an engaging method. Actually, when the toner is negatively charged and a reversal development is performed, the second regulating blade 15*a* can be formed by mounting a positive-chargeable silicone rubber with a hardness of 70 in JIS-A standard to an end portion of a stainless steel plate with a thickness of 0.1 to 2 mm.

The first toner carrier 14 must equally form a thin toner layer on its peripheral surface. Thus, the relation between the second toner carrier 15 and the electrostatic latent image holding member 10 must be carefully considered. The peripheral speed of the first toner carrier 14 is preferably 1.1 to 4 times higher than that of the electrostatic latent image holding member 10. The peripheral speed of the second toner carrier 15 is preferably 1.1 to 4 times higher than that of the first toner carrier 14. This is because when the peripheral speeds of the first toner carrier 14 and the second toner carrier 15 are too slow, a proper amount of single component toner cannot be adhered to an electrostatic latent image. In contrast, when these peripheral speeds are too fast, drive sources of the first toner carrier 14 and the second toner carrier 15 may be overloaded. The diameter of the first toner carrier 14 is preferably the same as that of the second toner carrier 15.

Generally, the first toner carrier 14 is an electroconductive rubber roller. As shown in FIG. 5, the first toner carrier 14 comprises a metal shaft 14*c*, an elastic layer 14*d*, and a surface electroconductive layer 14*e*. The elastic layer 14*d* coats the peripheral surface of the metal shaft 14*c*. The surface electroconductive layer 14*e* coats the peripheral surface of the elastic layer 14*d*. Instead of two layers of the elastic layer 14*d* and the surface electroconductive layer 14*e*, only the elastic layer 14*d* which is an electroconductive layer may be used. The rubber hardness in JIS-A standard of the first toner carrier 14 is preferably 50 or less so that the first toner carrier 14 has a satisfactory contact pressure against the second toner carrier 15. In addition, the peripheral surface of the first toner carrier 14 must be smooth so as to prevent the single component toner from being adhered to the first toner carrier 14. In addition, since the first toner carrier 14 is in contact with the first regulating blade 14*a*, the electrostatic latent image holding member 10, and the second toner carrier 15, a permanent set (%) (in JIS K 6301) of the elastic layer adversely takes place due to packaging state and long time storage. When the permanent set exceeds 10%, an uneven image tends to take place at intervals of the peripheral length of the first toner carrier 14. Thus, the elastic layer 14*d* is preferably made of a material with a permanent set of 10% or less, preferably 5% or less.

The relation between the rubber hardness and permanent set of the elastic substance which constructs the elastic layer 14*d* is in that the larger the rubber hardness is inversely proportional to the permanent set. Examples of the elastic substance which satisfies the characteristics required for the elastic layer 14*d* are electroconductive urethane rubber, electroconductive EPDM rubber, and silicone rubber. The electroconductive urethane rubber used in this embodiment had a hardness of 30 measured by an A type hardness tester according to JIS standard K 6301. The outer diameter of the elastic layer 14*d* was 18 mm. In addition, the elastic layer 14*d* made of the electroconductive urethane rubber was disposed in parallel with a stainless steel roller with a diameter of 60 mm so that the elastic roller formed on the peripheral surface of the metal shaft 14*c* was in contact with the stainless steel roller by a nipped width of 2 mm. A voltage of 100 V was applied between the metal shafts of these rollers. Thus, the electroconductive urethane rubber had an electric resistance of $3.4\times10^3$ Ω·cm. At that time, the permanent set (according to JIS K 6301) was 3.8%.

Since the surface conductive layer 14*e* of the first toner carrier (electroconductive rubber roller) 14 is directly in contact with the toner and the electrostatic latent image holding member 10, they must be prevented from being contaminated by plasticizer, vulcanizing agent, and process oil. The smoothness of the peripheral surface of the surface electroconductive layer 14*e* is preferably 3 μm Rz or less. When the smoothness of the peripheral surface of the surface electroconductive layer 14*e* exceeds 3 μm Rz, an uneven pattern on the peripheral surface tends to appear on a final image. The smoothness of 3 μm Rz or less of the surface electroconductive layer 14*e* can be easily accomplished by thickly forming the surface electroconductive layer 14*e* on the peripheral surface of the elastic layer 14*d* and then by controlling the outer diameter and surface roughness thereof according to sand blasting method or the like. Alternatively, after the elastic layer 14*d* has been coated on the peripheral surface of the metal shaft 14*c*, a coating material with a proper viscosity may be applied on the peripheral surface of the elastic layer 14*d* according to spray coating method, dipping coating method, knife edge coating method, or the like. In this case, the viscosity of the coating material is low in the order of spray coating method (most lowest)<dipping coating method (second lowest)≧knife edge coating method. The smoothness of 3 μm Rz or less of the peripheral surface of the surface electroconductive layer 14*e* can be accomplished when $T\geqq10\times S$ in the spray coating method and when $T\geqq5\times S$ in both the dipping coating method and the knife edge coating method, where the thickness of the coating material coated on the peripheral surface of the elastic layer 14*d* is T (μm) and the roughness of the peripheral surface of the elastic layer 14*d* is S (μm Rz).

Actually, a stock solution of an electroconductive polyurethane resin type coating material in which electroconductive fine carbon particles were dispersed (resistance: $10^3$Ω·cm) was mixed with a diluting solution which made by mixing methyl ethyl ketone (MEK) and tetrahydrofurane (THF) with a ratio of 1 to 1 so that the amount of stock solution was equal to the amount of the diluting solution. To charge the diluting solution with reverse electricity of the toner, 3% by weight of an acrylic resin type charging control agent had been added to the undiluted solution of the electroconductive polyurethane resin type coating material. Thus, the charging amount of the coating solution was +603 nC.

Next, the coating solution was fully agitated. The coating solution was coated by dipping method on the peripheral surface of the elastic layer 14*d* which was made of electroconductive urethane rubber and which was rinsed with a solvent. The coating solution was coated at a pulling speed of 2.5 mm/sec. Thereafter, the coating solution was dried for 30 min by air and then heated at 120° C. for 20 min. Thus, the first toner carrier (electroconductive rubber roller) 14 was produced. The thickness of the electroconductive layer 14*e* was 70 to 80 μm. The resistance between the metal shaft 14*c* and the electroconductive layer 14*e* was $10^3$Ω·cm. The hardness of the rubber was 35 (measured by an A type hardness tester according to JIS K 6301). The surface roughness was 3 μm Rz. The first regulating blade 14*a* is produced by mounting a chip on a fixing plate. The chip is produced by forming a layer with the reverse charging property as the toner on elastic rubber (such as silicone rubber or urethane rubber) or resin with a hardness of 30 to 85 (in JIS-A standard). The chip is mounted on an edge portion of the fixing plate (such as a stainless steel plate with a thickness of 0.1 to 2 mm) by bonding method, nipping method, or engaging method. Actually, when the toner is negatively charged and reverse development is performed, a positively charged silicone rubber chip with a hardness of 70 (in JIS-A standard) is mounted on an edge portion of a stainless steel plate with a thickness of 0.1 to 2 mm. Thus, the first regulating blade 14*a* can be produced.

Next, an experimental result of the image forming apparatus having the developing apparatus 13 which comprises the first toner carrier 14, the first regulating blade 14*a*, the second toner carrier 15, and the second regulating blade 15*a* (shown in FIG. 4) will be described. With the image forming apparatus, images with high quality could be formed. In the experiment, a negatively chargeable single component non-magnetic toner which was composed of 92 parts by weight of polyester resin, 4 parts by weight of carbon powder, 2 parts by weight of low molecular weight polypropylene, 2 parts by weight of metal complex dye, and 0.5 parts by weight of additives silica was used. The average particle diameter of the toner was 10 μm. The electrostatic latent image holding member (organic photosensitive drum) 10 was rotated at a peripheral speed of 50 mm/sec. The electrostatic latent image holding member 10 was charged at a voltage of −500 V by the charger (corona charger) 11. Thereafter, image information was recorded as an electrostatic latent image by the exposing means (laser light source) 12. The first toner carrier 14 was rotated at a peripheral speed of 60 mm/sec in the reverse direction of the electrostatic latent image holding member 10. The second toner carrier 15 was rotated at a peripheral speed of 100 mm/sec in the reverse direction of the first toner carrier 14. Thus, the electrostatic latent image was developed to a visible image. At that time, a voltage of −150 V was applied to the first toner carrier 14 by the power supply 18. On the other hand, a voltage of −200 V was applied to the second toner carrier 15 by the power supply 19. The first toner carrier 14 was pressured to the peripheral surface of the electrostatic latent image holding member 10 so as to perform a predetermined reversal development.

Next, the toner image formed on the peripheral surface of the electrostatic latent image holding member 10 was transferred to the recording medium 21 by a 6 kV DC corona discharging of the transferring means 22. Thereafter, the toner image was thermally-fixed by the fixing means 23. The resultant line image was clear, whereas the resultant solid image had equally high density (1.4 on a Macbeth densitometer) and which was free of fogging. In addition, the resultant gray scale image was nearly unaffected by the solid image. Thus, a high quality image was formed by the apparatus according to the first embodiment.

In the first embodiment, the first toner carrier 14 and the second toner carrier 15 constructed a part of the toner hopper 16. In addition, the first regulating blade 14*a* and the second regulating blade 15*a* were directly mounted on the toner hopper 16. However, as shown in FIG. 6, the first toner carrier 14 may be partially exposed to the outside. Moreover, the second toner carrier 15 may be disposed in the toner hopper 16.

Second Embodiment

Figure 7:
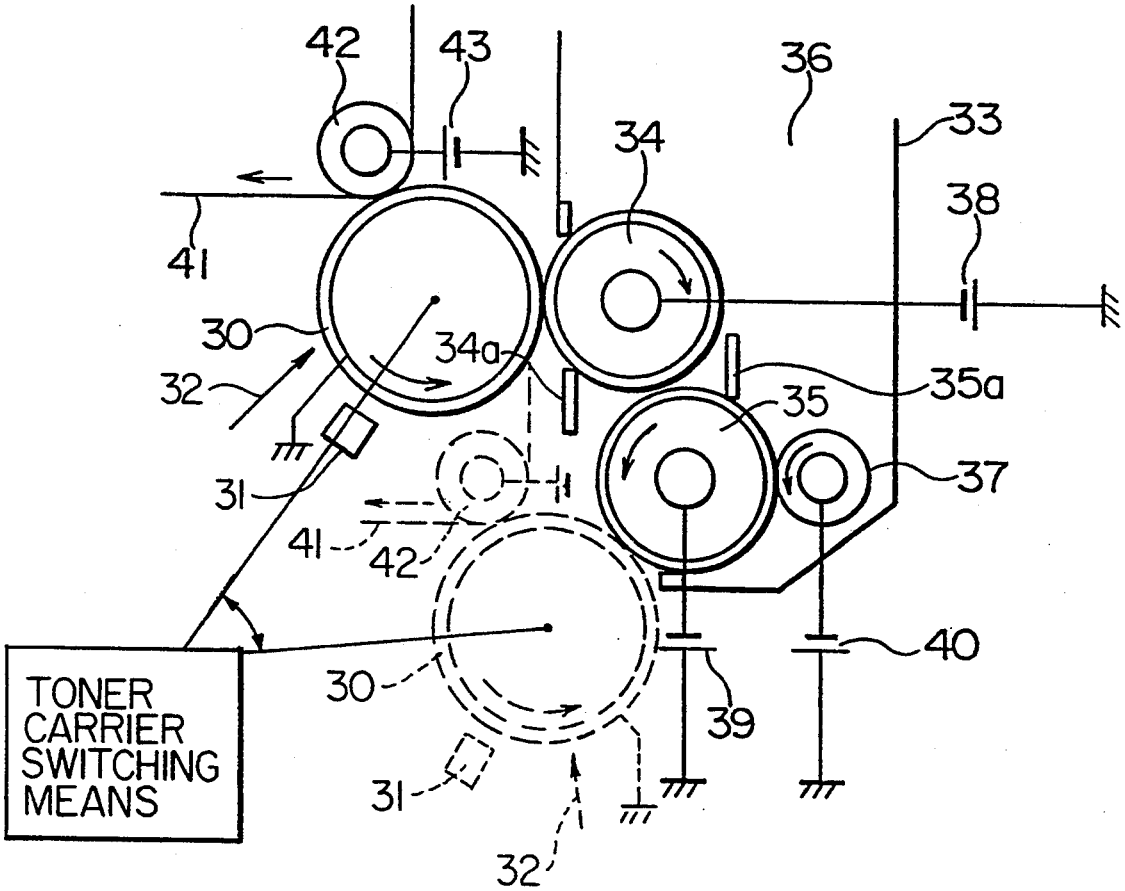
FIG. 7 is a sectional view showing the construction of principal portions of a developing apparatus according to an example of the second embodiment of the present invention.
Figure 8:
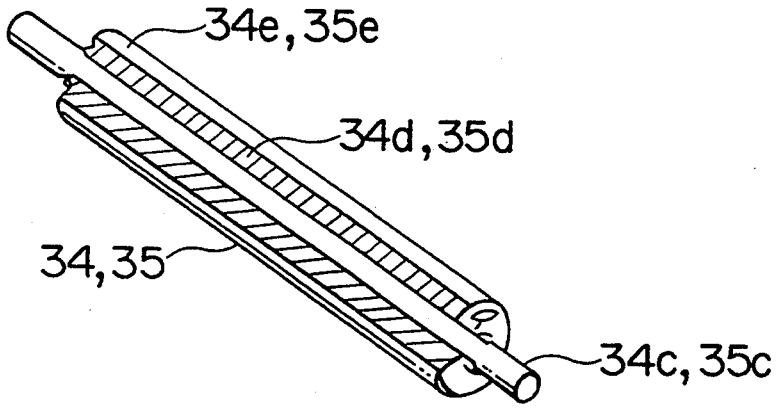
FIG. 8 is a partial perspective view showing the construction of first and second toner carriers of a developing apparatus according to a second embodiment of the present invention.

Next, with reference to FIGS. 7 and 8, a second embodiment of the present invention will be described. FIG. 7 is a sectional view showing the construction of principal portions of an image forming apparatus having a developing apparatus according to a second embodiment of the present invention. In the figure, reference numeral 30 is an electrostatic latent image holding member (for example, an organic photosensitive drum). Reference numeral 31 is a charger (for example, Scorotoron charger) which charges the peripheral surface of the electrostatic latent image holding member 30. Reference numeral 32 is an exposing means (for example, a laser light source) which forms an electrostatic latent image on the peripheral surface of the electrostatic latent image holding member 30 according to image information.

The developing apparatus 33 according to the second embodiment of the present invention comprises a first toner carrier 34, a first regulating blade 34*a*, a second toner carrier 35, a second regulating blade 35*a*, a toner hopper 36, a toner supply roller 37, and power supplies 38, 39, and 40. The first toner carrier 34 holds a single component toner on its peripheral surface and relatively approaches or contacts the single component toner with an electrostatic latent image on the peripheral surface of the electrostatic latent image holding member 10 so as to develop the electrostatic latent image to a visible image. The first regulating blade 34*a* comes in contact with the first toner carrier 34 and controls the thickness of a thin toner layer which is held on the peripheral surface of the first toner carrier 34. The second toner carrier 35 transfers the single component toner which is held on the peripheral surface to the peripheral surface of the first toner carrier 34. The second regulating blade 35*a* comes in contact with the second toner carrier 35 and controls the charging of the toner held on the peripheral surface of the second toner carrier 35. The toner hopper stocks the single component toner. The toner supply roller 37 supplies the toner onto the peripheral surface of the second toner carrier 34. The power supplies 38, 39, and 40 apply respective voltages to the first toner carrier 34, the second toner carrier 35, and the toner supply roller 37, respectively. In this embodiment, the developing apparatus 33 further comprises a toner carrier switching means (not shown) which relatively approaches or contact the second toner carrier 35 to or with the electrostatic latent image holding member 30.

Moreover, the developing apparatus 33 also comprises a transferring means (for example, a transfer roller) 42, a fixing means (for example, a heating roller), and a waste toner collecting means (not shown). The transferring means 42 transfers a visible image (toner image) formed on the peripheral surface of the electrostatic latent image holding member 30 to a recording medium 41 conveyed by a conveying means (not shown). The fixing means fixes the toner image onto the recording medium 41. The waste toner collecting means collects the waste toner adhered to the peripheral surface of the electrostatic latent image holding member 30.

The first toner carrier 34 and the second toner carrier 35 have the above-described functions, respectively. Thus, the material of the second toner carrier 35 must be selected in consideration of the charging characteristics and surface shape so that the second toner carrier 35 satisfactorily charges the toner along with the toner supply roller 37 and transfers a proper amount of toner. The material of the toner supply roller 37 must be selected in consideration of the work function and chargeable characteristics so that the frictional charging amount against the material of the toner is as large as possible. As with the material of the second toner carrier 35, the material of the first toner carrier 34 must be selected in consideration of the charging and transferring characteristics. However, the peripheral surface of the first toner carrier 34 is preferably smoother than that of the second toner carrier 35.

The second toner carrier 35 is contacted with the toner supply roller 37 so that a proper pressure and a proper contact area are obtained. The moving direction of the contact surface of second toner carrier 35 is in the reverse direction of that of the toner supply roller 37. Thus, the toner is frictionally charged. In addition, the second toner carrier 35 holds the one-component toner on its peripheral surface. The second regulating blade 35*a* controls the charging and thickness of the one-component toner on the peripheral surface of the second toner carrier 35. The toner on the peripheral surface of the second toner carrier 35 is contacted with the peripheral surface of the first toner carrier 34. At this time, relatively small diameter toner particles are adhered to the peripheral surface of the second toner carrier 35. On the other hand, relatively large diameter toner particles are present at an upper portion of the thin toner layer. When a proper electric field is applied between the peripheral surface of the second toner carrier 35 and the peripheral surface of the first toner carrier 34, the relatively small diameter toner particles reside on the peripheral surface of the second toner carrier 35. On the other hand, the relatively large diameter toner particles are transferred to the peripheral surface of the first toner carrier 34. At this time, when the electrostatic latent image holding member 30 is contacted with or approached to the first toner carrier 34, the electrostatic latent image on the electrostatic latent image holding member 30 is developed with the toner on the first toner carrier 34. Thus, the electrostatic latent image is developed to a visible image. In this case, developing characteristics suitable for a character image and a solid image requiring high image density are accomplished.

On the other hand, when the electrostatic latent image holding member 30 is approached to or contacted with the second toner carrier 35 by using the toner carrier switching means, the electrostatic latent image is developed with the relatively small diameter toner particles on the peripheral surface of the second toner carrier 35. In this case, a complicated graphic image and an image having a large number of narrow lines which require high resolution can be formed.

Thus, according to this embodiment, the particle size distribution of the single component toner varies depending on a plurality of toner carriers. By changing the relative positions of the electrostatic latent image holding member 30 and the developing apparatus 33 and contacting or approaching the electrostatic latent image holding member 30 with or to a proper toner carrier, an image corresponding to the toner size can be developed. The toner carrier switching means may be accomplished by a known mechanism such as a moving mechanism of a developing apparatus for use in an electrophotographic color copying machine. In addition, a process corresponding to the type of an output image may be performed. When a recording medium is conveyed two times through the apparatus, an image including characters and graphics may be formed without necessity of a special toner.

Next, with reference to FIG. 7, a real example of the second embodiment will be described. The first toner carrier 34 and the second toner carrier 35 shown in FIG. 7 are electroconductive rubber rollers which are substantially the same as the first toner carrier 14 shown in FIG. 5. In other words, to allow the electrostatic latent image holding member 30 to satisfactorily come in contact with the toner carrier and have an enough contact width therebetween and to allow two toner carriers to satisfactorily come in contact with each other and have an enough contact width therebetween, the rubber hardness thereof (in JIS-A standard) is preferably 50 or less. In addition, to prevent the single component toner from being adhered to the peripheral surface of the toner carrier or the electrostatic latent image holding member, the peripheral surface thereof must be smooth. Thus, as shown in FIG. 8, the first toner carrier 34 is constructed of a metal shaft 34*c*, an elastic layer 34*d*, and a surface electroconductive layer 34*e*. The metal shaft 34*c* is coated with the elastic layer 34*d* and the surface electroconductive layer 34*e*. On the other hand, the second toner carrier 35 is constructed of a metal shaft 35*c*, an elastic layer 35*d*, and a surface electroconductive substance layer 35*d*. The metal shaft 35*c* is coated with the elastic layer 35*d* and the surface electroconductive layer 35*e*. The material of the elastic layers 34*d* and 35*e* may not be electroconductive. However, since the surface electroconductive layers 34*e* and 35*e* may be peeled off and/or scratched, their material is preferably electroconductive. The elastic layer 34*d* is pressured to the first regulating blade 34*a*, the electrostatic latent image holding member 30, and the second toner carrier 35. The elastic layer 35*d* is pressured to the second regulating blade 35*a*, the electrostatic latent image holding member 30, and the first toner carrier 34. Thus, when the elastic layers 34*d* and 35*d* are kept in pressure-contact state for a long time, a permanent set takes place. In other words, when the compression set according to JIS K 6301 of the elastic layers 34*d* and 35*d* exceeds 10%, an uneven image periodically takes place due to the deformation of the toner carriers. Thus, the compression set of the elastic layers 34*d* and 35*d* must be 10% or less, preferably 5% or less. In addition, the larger the rubber hardness, the smaller the compression set. Thus, when the materials of the toner carriers are selected, these characteristics must be balanced.

In this embodiment, the material which satisfies the characteristics required for the elastic layers 34*d* and 35*d* is electroconductive urethane rubber. In addition, electroconductive EPDM rubber and the electroconductive silicone rubber also satisfy the required characteristics. Thus, these materials may be used. The hardness according to JIS K 6301 of the elastic layers 34*d* and 35*d* made of electroconductive urethane rubber (measured by an A type hardness tester) was approximately 30. The outer diameters of the elastic layers 34*d* and 35*d* were approximately 18 mm. The electric resistance of the electroconductive urethane rubber was measured in the same manner as that of the toner carrier 14 of the first embodiment. The resultant electric resistance was $3.2\times10^3\Omega\cdot$cm. The compression set of the electroconductive urethane rubber (which was measured according to JIS K 6301) was 3.7%.

Since the surface electroconductive layers 34*e* and 35*e* of the first toner carrier 34 and the second toner carrier 35 directly come in contact with the toner and the electrostatic latent image holding member 30, the materials of the surface electroconductive layers 34*e* and 35*e* must be free of plasticizer, vulcanizing agent, and process oil so as to prevent them from contaminating the toner and the electrostatic latent image holding member 30. The smoothness of the surface electroconductive layers 34*e* and 35*e* is preferably 3 μm Rz or less. When the smoothness exceeds 3 μm Rz, an uneven pattern tends to appear. The smoothness of 3 μm Rz or less of the peripheral surfaces of the surface electroconductive layers 34*e* and 35*e* may be accomplished in the same manner as the first embodiment. In other words, the surface electroconductive layers 34*e* and 35*e* are thickly formed on the peripheral surfaces of the elastic layers 34*d* and 35*d*, respectively. Thereafter, the outer diameter and surface roughness of these layers are controlled by sand blasting method or the like. Alternatively, the surface roughness may be controlled by spray coating method, dipping coating method, knife edge coating method, or the like described in the first embodiment rather than such post treatment.

In this embodiment, the surface electroconductive layers 34*e* and 35*e* were produced with the same coating solution as the surface electroconductive layer 14*e* of the first toner carrier 14 of the first embodiment by dipping method. In other words, a diluting solution was mixed with a stock solution of an electroconductive polyurethane resin type coating material where electroconductive carbon particles were dispersed and which had a resistance of approximately $10^3$ Ω·cm. The amount of the diluting solution was the same as the amount of the stock solution. Thereafter, a coating solution containing acrylic resin type charging control agent was coated on the peripheral surfaces of the elastic layers 34*d* and 35*d* which were made of electroconductive urethane rubber and rinsed with a solvent by dipping method. The pulling speed of the coating was 2.5 mm/sec. After the coating, the surface electroconductive layers 34*e* and 35*e* were dried for 30 min. in air. Next, the surface electroconductive layers 34*e* and 35*e* were heated at 100° C. for 20 min. The thickness of the surface electroconductive layers 34*e* and 35*e* were in the range from 50 to 60 μm. The resistance between the metal shaft 34*c* and the surface electroconductive layer 34*d* and between the metal shaft 35*c* and the surface electroconductive layer 35*d* was approximately $10^3$ Ω·cm. The rubber hardness of the surface electroconductive layers 34*e* and 35*e* was 35 (measured by the A type hardness tester according to JIS standard K 6301) and the surface roughness of 34*e* and 35*e* was 3 μm Rz.

The material of the first regulating blade 34*a* and the second regulating blade 35*a* preferably has the reverse charging polarity of the toner. In addition, the material of these regulating blades 34*a* and 35*a* must be selected so that as large charging amount as possible is obtained. When the first regulating blade 34*a* and the second regulating blade 35*a* are negatively charged, the material thereof is preferably an elastic rubber (such as silicone rubber or urethane rubber) or a resin with a hardness of 30 to 85 (in JIS A standard). In this embodiment, the regulating blades were made by integrally forming a blade made of silicone rubber and a fixing member. The waste toner collecting member (not shown) was made of a polyethylene film. The toner supply roller 17 was made by coating an electroconductive sponge on a metal shaft.

Next, with reference to FIG. 7, an experimental result of the developing apparatus 33 according to the second embodiment will be described. In the experiment, an image was formed in the following conditions.

As with the toner of the first embodiment, a toner composed of 92 parts by weight of polyester resin, 4 parts by weight of carbon powder, 2 parts by weight of low molecular weight polypropylene, 2 parts by weight of metal complex dye, and 0.5 part by weight of additive silica was used. The volume average grain diameter of the toner was 10 μm. The toner was a negatively chargeable single component non-magnetic type. The peripheral speed of the electrostatic latent image holding member (organic photosensitive drum) 30 was at 50 mm/sec. The peripheral surface of the electrostatic latent image holding member 30 was equally charged at a voltage of −500 V. Thereafter, image information was recorded by laser light so as to form an electrostatic latent image. The first toner carrier 34 was rotated at a peripheral speed of 60 mm/sec. On the other hand, the second toner carrier 35 was rotated at a peripheral speed of 100 mm/sec. A voltage of −200 V was applied to the first toner carrier 34 by the power supply 38. A voltage of −250 V was applied to the second toner carrier 35 by the power supply 39. By using the toner carrier switching means, the second toner carrier 35 was pressured to the peripheral surface of the electrostatic latent image holding member 30. Thus, a predetermined reversal development was performed. Next, a toner image formed on peripheral surface of the electrostatic latent image holding member 30 was transferred to a recording medium 41 in a 1.5 kV DC electric field and then the toner was thermally-fixed. The resultant image having a large number of narrow lines was clear and free of fogging. Next, by using the toner carrier switching means, the first toner carrier 34 was pressured to the peripheral surface of the electrostatic latent image holding member 30. Thus, a predetermined reversal development was performed. The peripheral speed and applied voltage of the first toner carrier 34 were the same as those of the second toner carrier 35. Next, a toner image formed on the electrostatic latent image holding member 30 was transferred in an 1.5 kV DC electric field to a recording medium 41 and then the toner was thermally-fixed. The resultant solid image and character image had good characteristics. The image density was 1.4 or more (measured by a Macbeth densitometer). Since the first toner carrier 34 is rotated in the reverse direction of the second toner carrier 35 as shown in FIG. 7, when the toner carrier was switched, the rotating direction thereof was reversed. According to the present invention, a plurality of toner carriers may be rotated in the same direction so as to simplify the construction of the developing apparatus.

Third Embodiment

Figure 9:
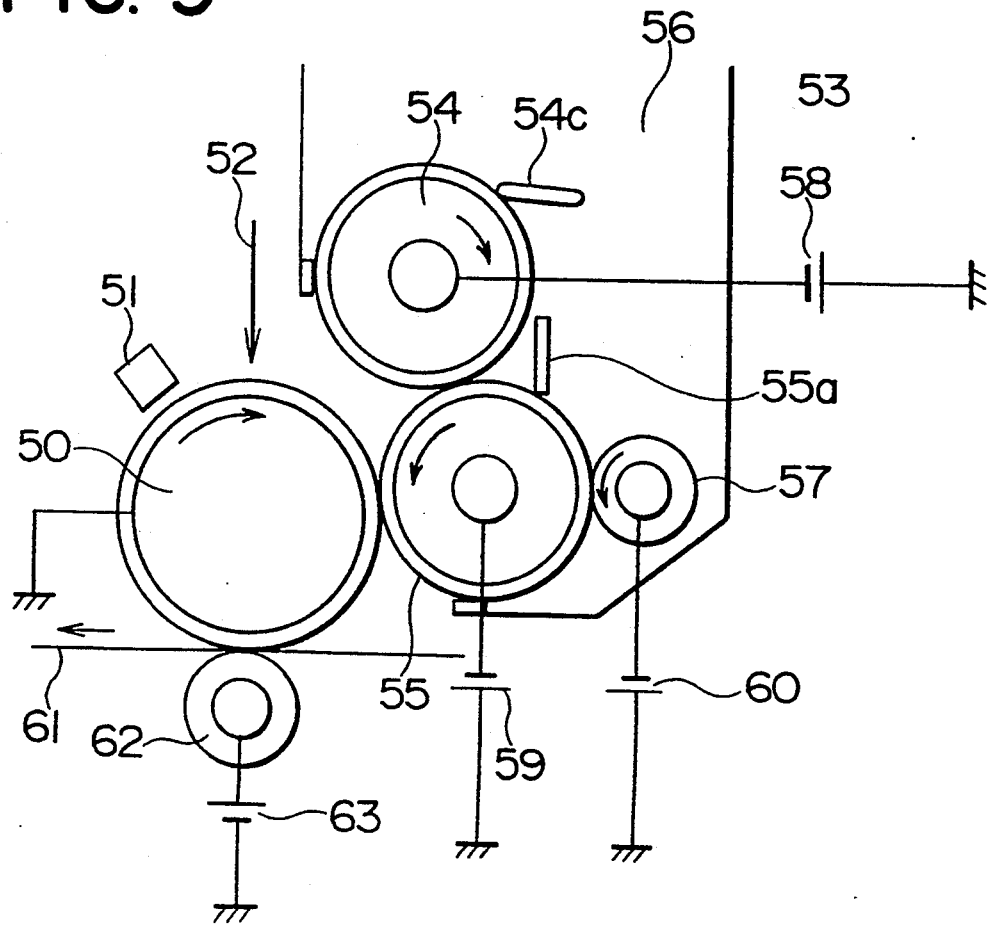
FIG. 9 is a sectional view showing the construction of principal portions of a developing apparatus according to a third embodiment of the present invention.

FIG. 9 shows the construction of principal portions of an image forming apparatus having a developing apparatus according to a third embodiment of the present invention. In the figure, reference numeral 50 is an electrostatic latent image holding member (for example, an organic photosensitive drum). Reference numeral 51 is a charger (for example, Scorotoron type charger) which charges the peripheral surface of the electrostatic latent image holding member 50. Reference numeral 52 is an exposing means (for example, a laser light source) which forms particular image information on the peripheral surface of the electrostatic latent image holding member 50 as an electrostatic latent image. Reference numeral 53 is a developing apparatus according to the present invention. The developing apparatus 53 comprises a second toner carrier 55, a second regulating blade 55*a*, a first toner carrier 54, a first regulating blade 54*c*, a toner hopper 56, a toner supply roller 57, and power supplies 58, 59, and 60. The second toner carrier 55 holds a single component toner on its peripheral surface and relatively approaches or contacts the single component toner to or with the electrostatic latent image on the peripheral surface of the electrostatic latent image holding member 50 so as to develop the image to a visible image. The second regulating blade 55*a* comes in contact with the second toner carrier 55 and controls the charging and the thickness of the single component toner. The first toner carrier 54 relatively approaches to or comes in contact with the peripheral surface of the second toner carrier 55 so as to receive the single component toner therefrom. The first regulating blade 54*c* comes in contact with the first toner carrier 54 and peels off and collects the toner held on the peripheral surface of the first toner carrier 54 as a waste toner collecting means. The toner hopper 56 stocks the single component toner. The toner supply roller 57 supplies the toner onto the peripheral surface of the second toner carrier 55. The power supplies 58, 59, and 60 apply respectively voltages to the first toner carrier 54, the second toner carrier 55, and the toner supply roller 57, respectively.

In addition, the developing apparatus 53 further comprises a transferring means (for example, a transfer roller) 62, a fixing means (for example, a heating roller, not shown), and a waste toner collecting means (not shown). The transferring means 62 transfers a visible image (toner image) formed on the peripheral surface of the electrostatic latent image holding member 50 conveyed by a conveying means (not shown) to a recording medium 61. The fixing means fixes the transferred toner image to the recording medium 61. The waste toner collecting means collects the remaining toner adhered to the peripheral surface of the electrostatic latent image holding member 50.

As described above, since the first toner carrier 54 and the second toner carrier 55 have respective functions, they have the following constructions. The material of the second toner carrier 55 must be selected in consideration of the charging characteristics and surface shape so that it satisfactorily charges the toner along with the toner supply roller 57 and transfers a proper amount of one-component toner. The material of the toner supply roller 57 must be selected in consideration of work function and chargeable characteristics so that the frictional charging amount against the material of the toner is as large as possible. As with the material of the second toner carrier 55, the material of the first toner carrier 54 must be selected in consideration of the charging and transferring characteristics. However, the smoothness of the peripheral surface of the first toner carrier 54 is preferably higher than that of the second toner carrier 55.

The second toner carrier 55 and the toner supply roller 57 which supplies the toner thereto must have predetermined contact pressure and contact area. The moving direction of the contact surface of the second toner carrier 55 is in the reverse direction of that of the toner supply roller 57. So that the second toner carrier 55 and the toner supply roller 57 sufficiently charge the toner by friction. The second toner carrier 55 holds and transfers the toner. The second regulating blade **55*a* controls the charging and thickness of the toner held and transferred on the peripheral surface of the second toner carrier 55. Thereafter, the toner on the peripheral surface of the second toner carrier 55 comes in contact with the peripheral surface of the first toner carrier 54. At this time, relatively small diameter toner particles are adhered to the peripheral surface of the second toner carrier 55. On the other hand, relatively large diameter toner particles are present at an upper portion of the thin toner layer. Thus, when a proper electric field is applied between the peripheral surfaces of the second toner carrier 55 and the first toner carrier 54, the small diameter toner particles are still adhered to the peripheral surface of the second toner carrier 55. On the other hand, the large diameter toner particles are transferred to the peripheral surface of the first toner carrier 54. The toner particles which have been transferred to the peripheral surface of the first toner carrier 54 are removed by the first regulating blade 54*c* so that new toner can be stably transferred. Thus, in this construction, the toner which develops the electrostatic latent image on the electrostatic latent image holding member 50** are small diameter toner particles which are suitable for developing an image with high resolution. An experiment in the same conditions as the second embodiment was performed. The experimental result revealed that a good image with high resolution was formed.

The image forming apparatus having the developing apparatus according to the present invention was described. As well as the single component non-magnetic toner, with a single component magnetic toner, the similar effect can be obtained. The toner carriers and the regulating blades which construct the developing apparatus may be modified without departing from the spirit and scope of the present invention.

As described above, according to the developing apparatus of the present invention, a stable and high quality image free of uneven density and fogging can be always formed.

In addition, according to the developing apparatus of the second embodiment of the present invention, with a conventional cheaper toner having a wide particle size distribution, since a toner carrier which forms a small diameter particle toner layer and another toner carrier which forms a large diameter particle toner layer can be selectively contacted with an electrostatic latent image holding member, an electrostatic latent image on the electrostatic latent image holding member can be developed corresponding to the type of the latent image. Thus, without necessity of an expensive toner having a narrow particle size distribution, an image with high resolution can be formed.

Although the present invention has been shown and described with respect to a best mode embodiment thereof, it should be understood by those skilled in the art that the foregoing and various other changes, omissions, and additions in the form and detail thereof may be made therein without departing from the spirit and scope of the present invention.

What is claimed is:

1. A developing apparatus for developing an electrostatic latent image formed on an electrostatic latent image holding member to a visible image with a single component toner, said apparatus comprising:

a first toner carrier having a peripheral surface for holding said single component toner on the peripheral surface;

a first regulating member in contact with said first toner carrier;

a second toner carrier having a peripheral surface for holding said single component toner and for relatively approaching to or coming in contact with said first toner carrier so as to transfer said single component toner to said first toner carrier; and a second regulating member in contact with said second toner carrier, wherein said second toner carrier is adapted to relatively approach to or come in contact with said electrostatic latent image holding member and transfer to said electrostatic latent image holding member a single component toner which resides on the peripheral surface of said second toner carrier after the single component toner has been transferred from said second toner carrier to said first toner carrier to develop the electrostatic latent image to the visible image with the single component toner.

2. The developing apparatus of claim 1, wherein said first toner carrier is rotated in the reverse direction to said second toner carrier.

3. The developing apparatus of claim 1, further comprising a toner supply member for supplying said single component toner on a peripheral surface of said second toner carrier.

4. The developing apparatus claim 3, wherein said toner supply member is a roller that rotatably contacts the peripheral surface of said second toner carrier, the peripheral surface of said second toner carrier being moved in the reverse direction of that of said toner supply member.

5. The developing apparatus of claim 1, wherein the peripheral surface of said first toner carrier is smoother than the peripheral surface of said second toner carrier.

6. The developing apparatus of claim 5, wherein a surface roughness of said first toner carrier is 3 μm Rz or less.

7. A developing apparatus for developing an electrostatic latent image formed on an electrostatic latent image holding member to form a visible image with a single component toner, said apparatus comprising:

first toner carrier means, comprising a first toner carrier having a first peripheral surface for holding a layer of said single component toner and a first regulating member in contact with said first peripheral surface;

second toner carrier means comprising a second toner carrier having a second peripheral surface for holding a layer of said single component toner and a second regulating member in contact with said second peripheral surface, said second toner carrier being rotatably disposed to relatively approach or come in contact with said first toner carrier so as to transfer said single component toner layer formed on said second peripheral surface to said first peripheral surface; and switching means for relatively and selectively disposing said first toner carrier or said second toner carrier to approach or come in contact with a peripheral surface of said electrostatic latent image holding member and transfer to said peripheral surface of said electrostatic latent image holding member either the toner held on said first peripheral surface or on said second peripheral surface after the toner layer held on said second peripheral surface has been transferred to said first peripheral surface.

8. The developing apparatus of claim 7, further comprising a toner supply member for supplying said single component toner to said second peripheral surface.

9. The developing apparatus of claim 8, wherein said toner supply member is a roller that rotatably contacts said second peripheral surface, said second peripheral surface being moved in the reverse direction of that of said toner supply member so as to frictionally charge said single component toner.

10. The developing apparatus of claim 7, wherein said first peripheral surface is smoother than said second peripheral surface.

11. The developing apparatus of claim 10, wherein a surface roughness of said first toner carrier is 3 μm Rz or less.

* * * * *

UNITED STATES PATENT AND TRADEMARK OFFICE

CERTIFICATE OF CORRECTION

PATENT NO. : 5,412,456

DATED : May 02, 1995

INVENTOR(S) : Chiaki TANUMA et al

It is certified that error appears in the above-indentified patent and that said Letters Patent is hereby corrected as shown below:

Claim 7, Column 19, Line 29, after "means", insert --,--.

Signed and Sealed this

Third Day of October, 1995

*Attest:*

Bruce Lehman

BRUCE LEHMAN

*Attesting Officer*

*Commissioner of Patents and Trademarks*